US005516268A

United States Patent [19]

Kassen et al.

[11] Patent Number: 5,516,268

[45] Date of Patent: May 14, 1996

[54] VALVE-IN-STAR MOTOR BALANCING

[75] Inventors: Gary R. Kassen, Chanhassen; Marvin L. Bernstrom, Eden Prairie, both of Minn.

[73] Assignee: Eaton Corporation, Cleveland, Ohio

[21] Appl. No.: 506,505

[22] Filed: Jul. 25, 1995

[51] Int. Cl.[6] ..... F03C 2/08; F04C 2/10

[52] U.S. Cl. ..... 418/61.3; 418/186; 418/187

[58] Field of Search ..... 418/61.3, 131, 418/132, 133, 186, 187, 188

[56] References Cited

U.S. PATENT DOCUMENTS

| | | | |
|---|---|---|---|
| 3,233,524 | 2/1966 | Charlson | 91/56 |
| 3,825,376 | 7/1974 | Petersen et al. | 418/61 B |
| 3,876,343 | 4/1975 | Giversen | 418/61 B |
| 4,357,133 | 11/1982 | White | 418/61 B |
| 4,411,606 | 10/1983 | Miller | 418/61 B |
| 4,715,798 | 12/1987 | Bernstrom | 418/186 |
| 4,741,681 | 5/1988 | Bernstrom | 418/61 B |
| 4,976,594 | 12/1990 | Bernstrom | 418/61.3 |

*Primary Examiner*—Charles Freay
*Attorney, Agent, or Firm*—L. J. Kasper

[57] ABSTRACT

A gerotor motor of the valve-in-star type in which the star (27) is disposed adjacent a stationary valve plate (15). The stationary valve plate (15) defines a plurality N+1 of stationary ports (65) in communication with the inlet port (55). The gerotor star (27) defines a plurality N of fluid ports (51) each including a radially inner portion (53). The inner portions (53) and the stationary port (65) are in commutating fluid communication as the star (27) orbits and rotates, in accordance with an important aspect of the invention. As a result, the star member (27) is exposed to a smaller area of pressurized fluid at the stationary valve plate (15), thus making it possible to achieve more consistent overbalance of the star, for either direction of rotation. This results in substantially improved overall efficiency of the motor.

3 Claims, 5 Drawing Sheets

VALVE-IN-STAR MOTOR BALANCING

BACKGROUND OF THE DISCLOSURE

The present invention relates to rotary fluid pressure devices, and more particularly, to such devices which include gerotor displacement mechanisms utilizing low-speed, commutating valving.

In a conventional gerotor motor utilizing low-speed, commutating valve (i.e., the rotary valve element rotates at the speed of rotation of the gerotor star rather than at the orbiting speed of the star) the valving action has been accomplished by means of a rotary valve member and a stationary valve member, with both valve members being separate from the gerotor displacement mechanism.

In recent years, those skilled in the art have developed what may be termed a "valve-in-star" (VIS) gerotor motor, an example of which is illustrated and described in U.S. Pat. No. 4,741,681, assigned to the assignee of the present invention and incorporated herein by reference. In a VIS motor, the commutating valving action is accomplished at an interface between the orbiting and rotating gerotor star, and an adjacent, stationary valve plate, which is typically part of the motor housing.

Although "commutating" valving action is well known to those skilled in the gerotor motor art, a brief explanation will be provided herein. In a typical gerotor motor, the ring member defines a plurality N+1 of internal teeth, and the orbiting and rotating star defines a plurality N of external teeth. The stationary valve member then defines a plurality N+1 valve passages communicating with the expanding and contracting fluid volume chambers of the gerotor, while the rotary valve member (orbiting and rotating star in the case of a VIS motor) defines a plurality N of fluid ports at high pressure ("system pressure"), and a plurality N of fluid ports at low pressure (return or exhaust). The progressive fluid communication between each of the N ports and each of the N+1 fluid passages, as the star orbits and rotates, comprises the commutating valving.

In a typical VIS motor, system pressure is communicated through the end cap, and the stationary valve surface, axially to a transverse face of the gerotor star, thus subjecting the star to a substantial axial separating force, tending to bias the star away from the stationary valve surface. Therefore, it has been necessary to provide a means to accomplish "overbalance" of the star, such that there is a net force tending to bias the star toward the stationary valve surface. This may be accomplished by providing the "backside" of the star (i.e., the side of the star opposite the end cap) with a pressure overbalance region, and then communicating system pressure into the region, from whichever set of star ports contains high pressure. Such an arrangement is illustrated and described in U.S. Pat. No. 4,976,594, assigned to the assignee of the present invention and incorporated herein by reference.

In commercial VIS motors produced by the assignee of the present invention (the Hydraulics Operations Worldwide of Eaton Corporation), communication of fluid to and from the star is accomplished by means of a pair of pressure chambers (or regions) defined by the end cap assembly. The first pressure chamber is annular, and the second pressure chamber is circular and is surrounded by the first pressure chamber. The above-described pressure chamber arrangement is illustrated and described in greater detail in both of the above-incorporated patents. Although the operating performance of the pressure chamber arrangement described above has been generally satisfactory, it has made pressure balancing of the star quite difficult. As will be understood by those skilled in the art of VIS motors, the annular, first pressure chamber has a larger area than the circular, second pressure chamber. As a result, when the second pressure chamber contains high pressure (for example, when the motor is operating counter-clockwise (CCW)), there is a much smaller hydraulic separating force acting on the star than when the first pressure chamber contains high pressure (when the motor is operating clockwise (CW)). Therefore, for a given pressure balance area on the backside of the star, there will be a much greater overbalance on the star when the motor is operating CCW than when the motor is operating CW.

As an example, during the development of the motor comprising the subject embodiment, using the pressure chamber arrangement described above, there was a 24% overbalance in the CCW direction, but a 0% "overbalance" in the CW direction. Those skilled in the art will recognize that a 0% overbalance is, in reality, no overbalance at all, and there is a great potential for axial separation of the star from the stationary valve plate, followed by cross-port leakage and stalling of the motor.

A seemingly obvious solution to the above problem would be to reduce the area of the annular, first pressure chamber, i.e., reduce the radial dimension of the first pressure chamber. However, reducing the area of the first pressure chamber, which must communicate with ports defined by an orbiting and rotating star, would typically reduce the area of communication therebetween enough to increase the pressure differential (pressure drop) across the motor to an undesirably high level.

SUMMARY OF THE INVENTION

Accordingly, it is an object of the present invention to provide an improved VIS motor design which provides for improved axial pressure balancing of the star, and more specifically, makes it possible to achieve a reasonable pressure overbalance for either direction of motor operation.

It is a more specific object of the present invention to provide an improved valving arrangement for a VIS motor in which the area of overlap of the annular, first pressure chamber and the adjacent star ports more nearly approximates the area of overlap of the star fluid ports and the stationary valve passages.

It is a further object of the present invention to provide an improved VIS motor which accomplishes the above-stated objects without restricting fluid flow from the annular, first pressure chamber to the star ports to such an extent that the pressure differential across the motor becomes excessive.

The above and other objects of the invention are accomplished by the provision of an improved rotary fluid pressure device of the type comprising housing means including an end cap member defining a fluid inlet port and a fluid outlet port. A gerotor gear set is associated with the housing means and includes an internally-toothed ring member defining a plurality N+1 of internal teeth, and an externally-toothed star member defining a plurality N of external teeth, the star member being eccentrically disposed within the ring member for orbital and rotational movement relative thereto. The teeth of the ring member and the star member interengage to define a plurality N+1 of expanding and contracting fluid volume chambers during the relative orbital and rotational movements. The end cap member includes stationary valve means including a first fluid pressure region in continuous fluid communication with the inlet port, and a second fluid pressure region in continuous fluid communication with the outlet port, the first region surrounding the second region. The stationary valve means further defines a plurality N+1 of valve passages, each being in continuous fluid communication with one of the fluid volume chambers. The star member defines a manifold zone in continuous fluid communication with the second fluid pressure region, the star member including an end surface disposed in sliding, sealing engagement with an adjacent surface of the stationary valve means. The end surface of the star member defines a first plurality N of fluid ports and a second plurality N of fluid ports, the second plurality of fluid ports being in continuous fluid communication with the manifold zone.

The improved rotary fluid pressure device is characterized by each of the first plurality N of fluid ports including inward portions extending radially inwardly beyond each of the second plurality N of fluid ports. The first fluid pressure region comprises a plurality N+1 of individual stationary ports defined by the adjacent surface of the stationary valve means. Each of the N+1 stationary ports is in commutating fluid communication with each of the inward portions of the first plurality N of fluid ports defined by the star member during the relative orbital and rotational movements.

DESCRIPTION OF THE PREFERRED EMBODIMENT

Figure 1:
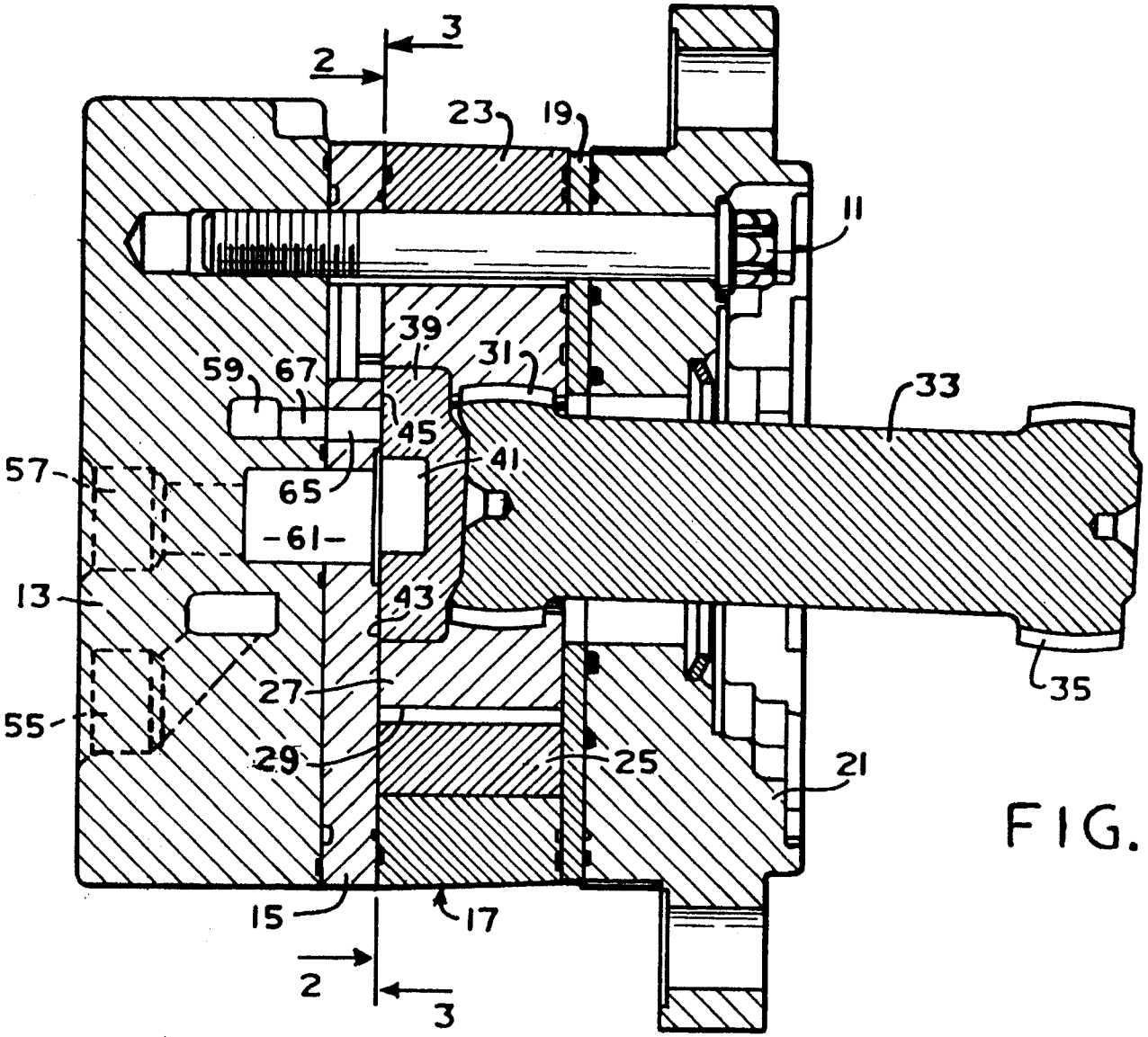
FIG. 1 is an axial cross-section illustrating a low-speed, high-torque VIS gerotor motor made in accordance with the present invention.

Referring now to the drawings, which are not intended to limit the invention, FIG. 1 illustrates a VIS motor made in accordance with the above-incorporated patents. More specifically, the VIS motor shown in FIG. 1 is, by way of example only, of a "modular" design, made in accordance with the teachings of U.S. Pat. No. 5,211,551, assigned to the assignee of the present invention and incorporated herein by reference.

Figure 3:
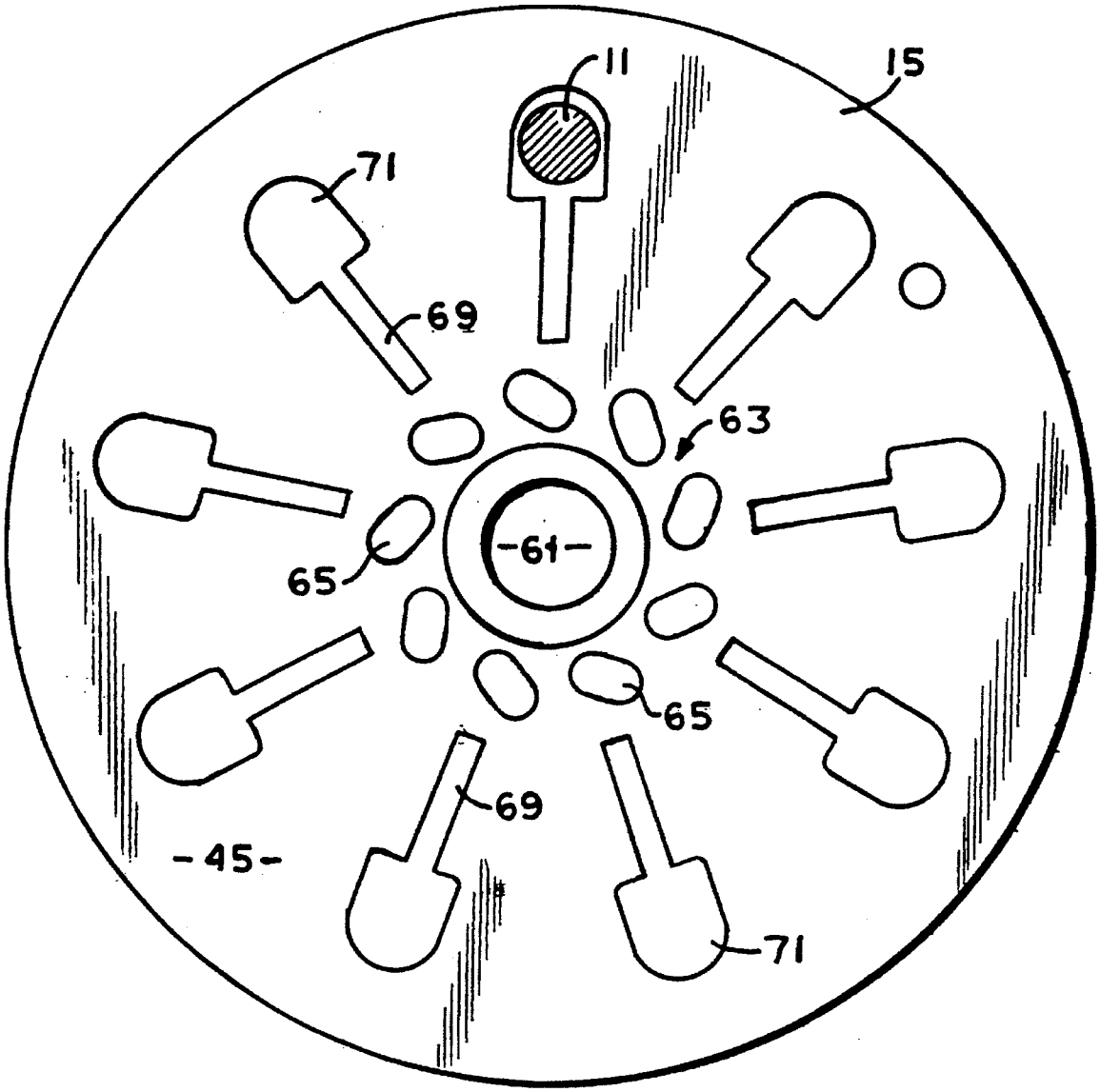
FIG. 3 is a transverse cross-section, taken on line 3—3 of FIG. 1, and on a scale larger than that of FIG. 1 but smaller than that of FIG. 2.

The VIS motor shown in FIG. 1 comprises a plurality of sections secured together such as by a plurality of bolts 11, only one of which is shown in each of FIGS. 1 and 3. The motor includes an end cap 13, a stationary valve plate 15, a gerotor gear set, generally designated 17, a balance plate 19, and a flange member 21.

The gerotor gear set 17 is well known in the art, is shown and described in greater detail in the above-incorporated patents, and therefore will be described only briefly herein. The gear set 17 is preferably a Geroler® gear set comprising an internally toothed ring member 23 defining a plurality of generally semi-cylindrical openings, with a cylindrical roller member 25 disposed in each of the openings, and serving as the internal teeth of the ring member 23. Eccentrically disposed within the ring member 23 is an externally-toothed star member 27, typically having one less external tooth than the number of internal teeth 25, thus permitting the star member 27 to orbit and rotate relative to the ring member 23. The orbital and rotational movement of the star 27 within the ring 23 defines a plurality of expanding and contracting fluid volume chambers 29.

Referring still primarily to FIG. 1, the star 27 defines a plurality of straight, internal splines which are in engagement with a set of external, crowned splines 31, formed on one end of a main drive shaft 33. Disposed at the opposite end of the shaft 33 is another set of external, crowned splines 35, adapted to be in engagement with another set of straight internal splines defined by some form of rotary output member, such as a shaft or wheel hub (not shown). As is well known to those skilled in the art, gerotor motors of the general type shown herein may include an additional rotary output shall supported by suitable bearings. For purposes of the subsequent description, and the appended claims, the main drive shaft 33 may be considered a form of output shaft, and the splines 31 and 35 may be considered the means which transmit torque to the output shaft.

Figure 2:
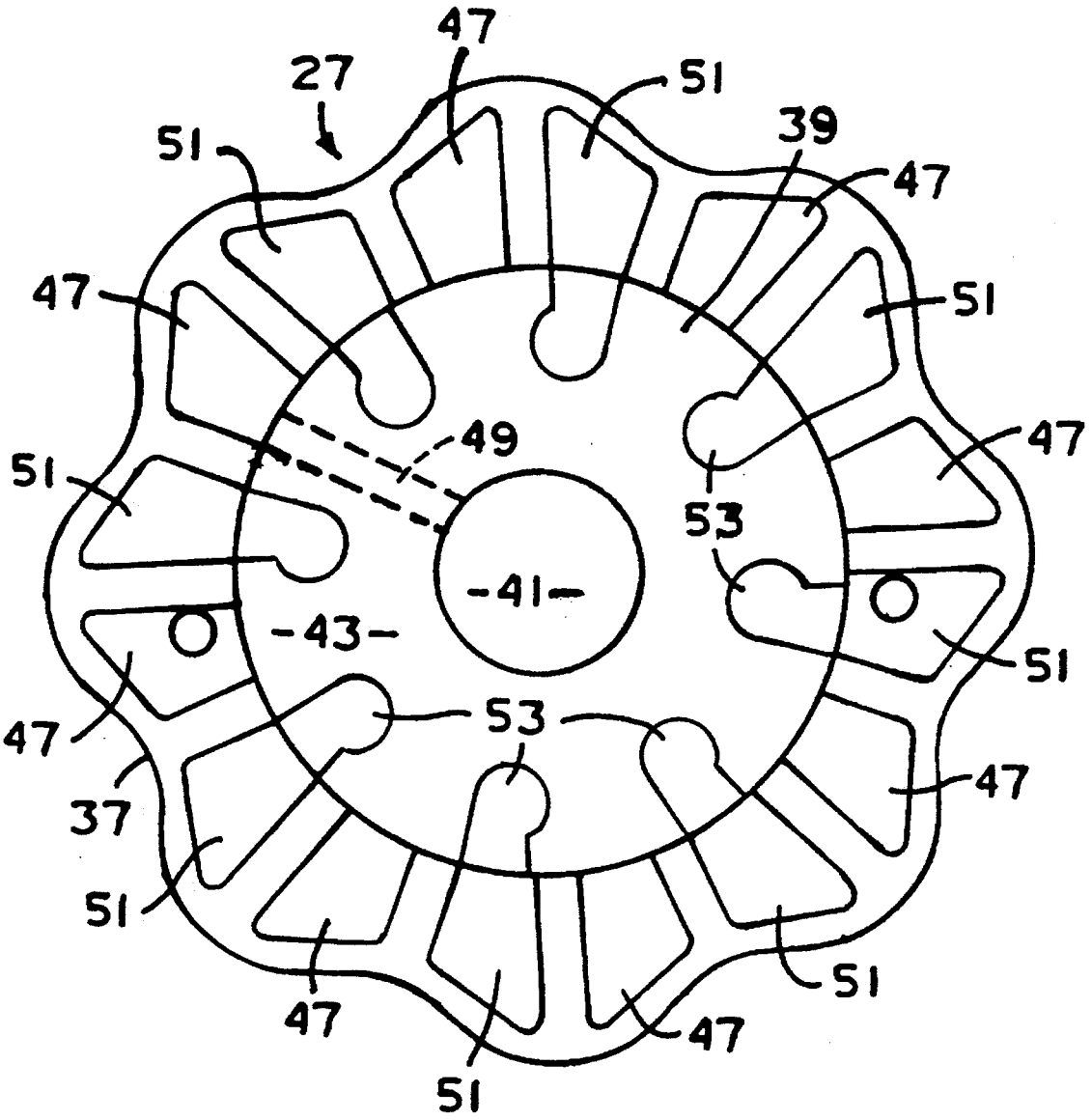
FIG. 2 is a transverse cross-section, taken on line 2—2 of FIG. 1, but illustrating only the gerotor star, and on a scale larger than FIG. 1.

Referring now primarily to FIG. 2, in conjunction with FIG. 1, the star member 27 will be described in greater detail. Although not an essential feature of the present invention, it is preferable that the star 27 comprise an assembly of two separate parts. In the subject embodiment, the star 27 comprises two separate parts including a main star portion 37, which includes the external teeth, and an insert or plug 39. The main portion 37 and the insert 39 cooperate to define the various fluid zones, passages, and ports which will be described subsequently.

The star member 27 defines a central manifold zone 41, defined by an end surface 43 of the star 27, the end surface 43 being disposed in sliding, sealing engagement with an adjacent surface 45 (see FIG. 3) of the stationary valve plate 15.

The end surface 43 of the star 27 defines a set of fluid ports 47, each of which is in continuous fluid communication with the manifold zone 41 by means of a fluid passage 49, defined by the insert 39 (only one of the fluid passages 49 being shown in FIG. 2). The end surface 43 further defines a set of fluid ports 51, which are arranged alternately with the fluid ports 47, each of the fluid ports 51 including a portion 53 which is defined by the insert 39 and extends radially inward, about half way, radially, to the manifold zone 41.

Referring now primarily to FIG. 3, in conjunction with FIG. 1, the end cap 13 and stationary valve plate 15 will be described in further detail. As may be seen from a review of the above-incorporated patents, it is known in the art to have the endcap and stationary valve plate formed as separate members, as in the subject embodiment, which then may also be referred to as an "endcap assembly". Alternatively, the endcap and stationary valve may comprise a single, integral part, in which case, reference to a "stationary valve means" or some similar terminology will be understood to refer to the portion of the endcap disposed immediately adjacent the gerotor gear set.

The endcap 13 includes a fluid inlet port 55 and a fluid outlet port 57. The endcap 13 defines an annular chamber 59 which is in open, continuous fluid communication with the inlet port 55. The endcap 13 and the stationary valve plate 15 cooperate to define a cylindrical chamber 61 which is in continuous, open fluid communication with the outlet port 57, and with the manifold zone 41, as the star 27 orbits and rotates.

Referring still primarily to FIG. 3, as was noted in the BACKGROUND OF THE DISCLOSURE, in the prior an VIS motors, the chamber 61 would have been surrounded by an annular pressure chamber having an effective area under pressure much larger than that of the chamber 61. However, in accordance with one aspect of the present invention, the annular pressure chamber of the prior art comprises a fluid pressure region, generally designated 63, which includes a plurality of individual stationary pressure ports 65, each of which is in continuous fluid communication with the annular chamber 59 by means of a passage 67 (see FIG. 1). It should be apparent to those skilled in the art that the total area under pressure of the ports 65 is substantially less than would be the area of an equivalent annular pressure chamber of the prior art. Therefore, the total separating force as a result of high pressure in the ports 65 will be substantially less than would be the case with the prior to art annular chamber.

The stationary valve plate 15 further defines a plurality of stationary valve passages 69, also referred to in the art as "timing slots". In the subject embodiment, each of the valve passages 69 would typically comprise a radially-oriented slot, each of which would be disposed in continuous, open fluid communication with an adjacent one of the volume chambers 29. Preferably, the valve passages 69 are disposed in a generally annular pattern which is concentric relative to the fluid pressure region 63, as is illustrated in FIG. 3. In the subject embodiment, and by way of example only, the valve passages 69 each open into an enlarged portion 71. Each of the bolts 11 passes through one of the enlarged portions 71, but as may be seen in FIG. 3, and in FIGS. 4 through 7, even with the bolt 11 present, fluid can still be communicated to and from the volume chambers 29 through the radially inner part of each enlarged portion 71.

Referring again primarily to FIG. 1, the plate 19 functions as a "balancing plate", in accordance with the teachings of above-incorporated U.S. Pat. No. 4,976,594. System pressure (high pressure) is communicated to the backside (side adjacent the flange member 21 ) of the plate 19. For either direction of operation, the radially inward portion of the plate 19 is biased toward the star member 27. In other words, throughout one entire orbit of the star member 27, there is a net force biasing the plate 19 toward the star. However, for various reasons such as a slight tipping or cocking of the star, there may be localized areas in which there is a slight separation of the balancing plate 19 from the star 27.

During operation, high pressure fluid is communicated to the inlet port 55, and from there flows to the annular chamber 59, then through the individual passages 67 and into the pressure ports 65. As the star 27 orbits and rotates, the nine pressure ports 65 engage in commutating fluid communication with the eight radially inward portions 53 of the fluid ports 51 defined by the star 27. Thus, high pressure fluid is being communicated only to those fluid ports 51 which are in fluid communication with one of the valve passages 69, or are about to have such communication or have just completed such communication, as will be described subsequently in connection with FIGS. 4 through 7.

High pressure fluid is communicated only to those fluid ports 51 which are on the same side of the line of eccentricity as the expanding volume chambers, so that high pressure fluid then flows from those particular fluid ports 51 through the respective stationary valve passages 69, and enlarged portions 71, into the expanding volume chambers 29.

Low pressure exhaust fluid flowing out of the contracting volume chambers 29 is communicated through the respective enlarged portions 71 and valve passages 69 into the fluid ports 47 defined by the star member 27. This low pressure fluid is then communicated through the radial fluid passages 49 into the manifold zone 41, and from there, the low pressure fluid flows through the cylindrical chambers 61, and then to the outlet port 57. It will be understood by those skilled in the art that the overall flow path just described is generally well known in the art.

Referring now primarily to FIGS. 4–7, one important aspect of the present invention will be described. It should be noted that in FIGS. 4–7, the view is toward the valve plate 15, in the same manner as in FIG. 3, but the elements of the star 27 appear "reversed" from the view in FIG. 2 because, in FIGS. 4–7, the element of the star 27 are being viewed in a direction opposite that of FIG. 2.

Figure 4:
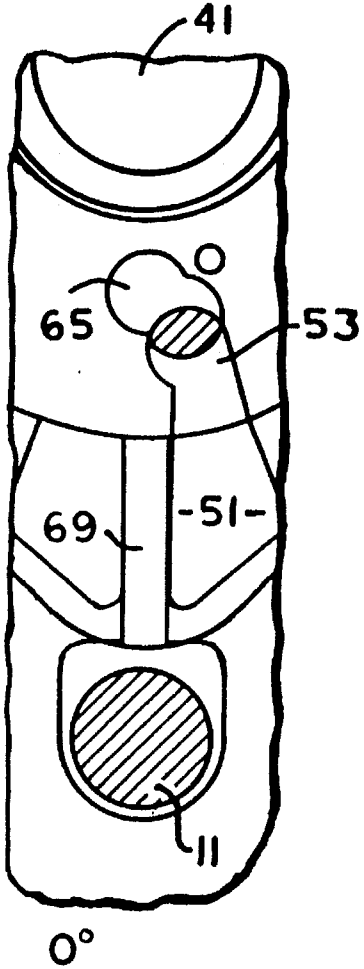

Referring now primarily to FIG. 4, when a particular external tooth of the star 27 is in a "bottom dead center" position, as shown in FIG. 4, the pressurized fluid port 51 is just approaching a line-to-line communication with the stationary valve passage 69. However, even before communication between the port 51 and the passage 69, pressurized fluid is communicated through the area of overlap (shaded area) between the pressure port 65 and the inward portion 53 of the fluid port 51, in preparation for communication from the port 51 to the passage 69, thus assuring that there will not be any cavitation when communication from the port 51 to the passage 69 first occurs.

Figure 5:
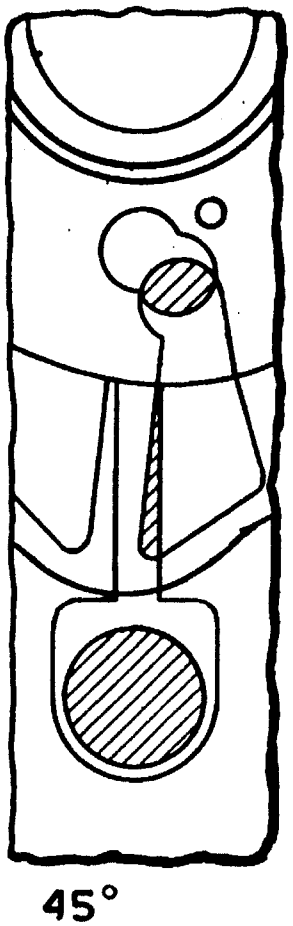

Referring now primarily to FIG. 5, after 45 degrees of orbital movement of the star 27, the area of overlap (shaded area) between the pressure port 65 and the inward portion 53 has increased somewhat. At the same time, the area of overlap (shaded area) of the fluid port 51 and the passage 69 has also increased substantially such that the second area of overlap is approaching, and is approximately equal to, the first area of overlap. For simplicity of illustration and explanation, it will be assumed that the areas of overlap shown in FIGS. 4 through 7 are representative of the actual flow areas between the particular ports and passages involved.

Figure 6:
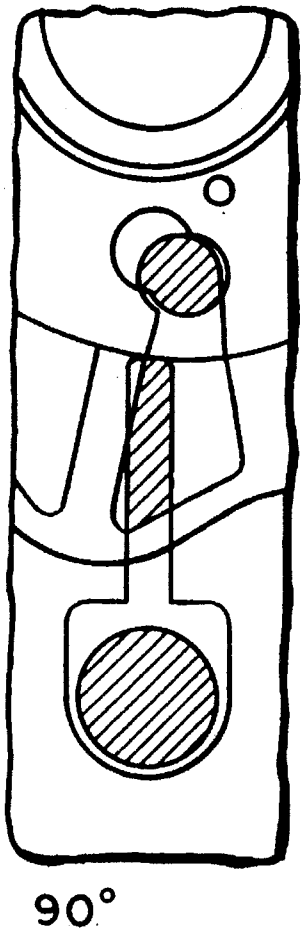

Referring now primarily to FIG. 6, by the time the star 27 has reached about 90 degrees of orbital movement, the first area of overlap between the pressure port 65 and the inward portion 53 has increased even further, reaching approximately its maximum flow area. At the same time, the second area of overlap, between the fluid port 51 and the passage 69 has increased to its maximum flow area, with the first and second areas of overlap (flow areas) being very nearly equal.

Figure 7:
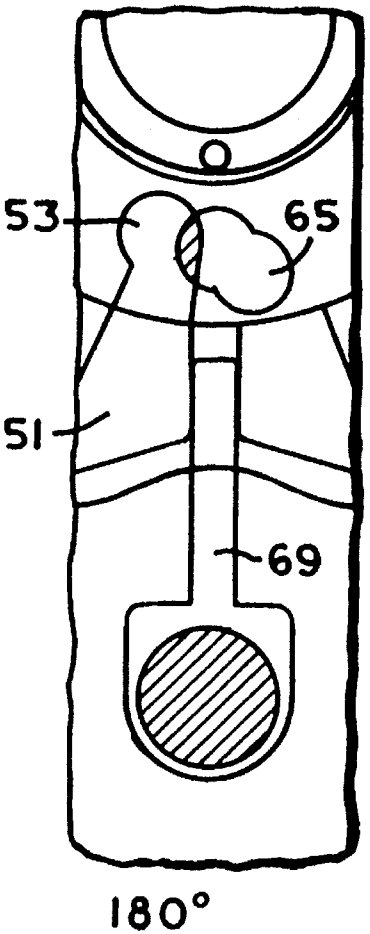
FIGS. 4–7 are fragmentary, overlay views illustrating the operation of the present invention in four different orbital and rotational positions of the star.

As the star member 27 continues to orbit, past the 90 degree position shown in FIG. 6, each of the areas of overlap begins to decrease, with the second area of overlap, between the fluid port 51 and the passage 69, decreasing somewhat more rapidly. Finally, the position shown in FIG. 7 is reached when the star has orbited 180 degrees, and the fluid port 51 has just passed out of line-to-line contact with the passage 69. In other words, the second area of overlap has become zero. At the same time, the first area of overlap, between the pressure port 65 and the inward portion 53, has decreased to the very small area of overlap shown in FIG. 7.

FIGS. 4–7 illustrate an important aspect of the present invention whereby the first and second areas of overlap are "approximately equal" during the one-half of each orbit during which high pressure is being communicated to expanding volume chambers. By "approximately equal" it is meant that the two areas of overlap are of the same general order of magnitude, and that they are both increasing at the same time (from zero degrees to 90 degrees) and then are both decreasing at the same time (from 90 degrees to 180 degrees). As a practical matter, and for reasons which will be understood by those skilled in the art, the first area of overlap is larger than the second area of overlap near the beginning of the orbital cycle and toward the end of the orbital cycle. However, the first and second areas of overlap will be considered "approximately equal", as that term is used hereinafter and in the appended claims, as long as the areas of overlap have the type of relationship illustrated in FIGS. 4–7.

Figure 8:
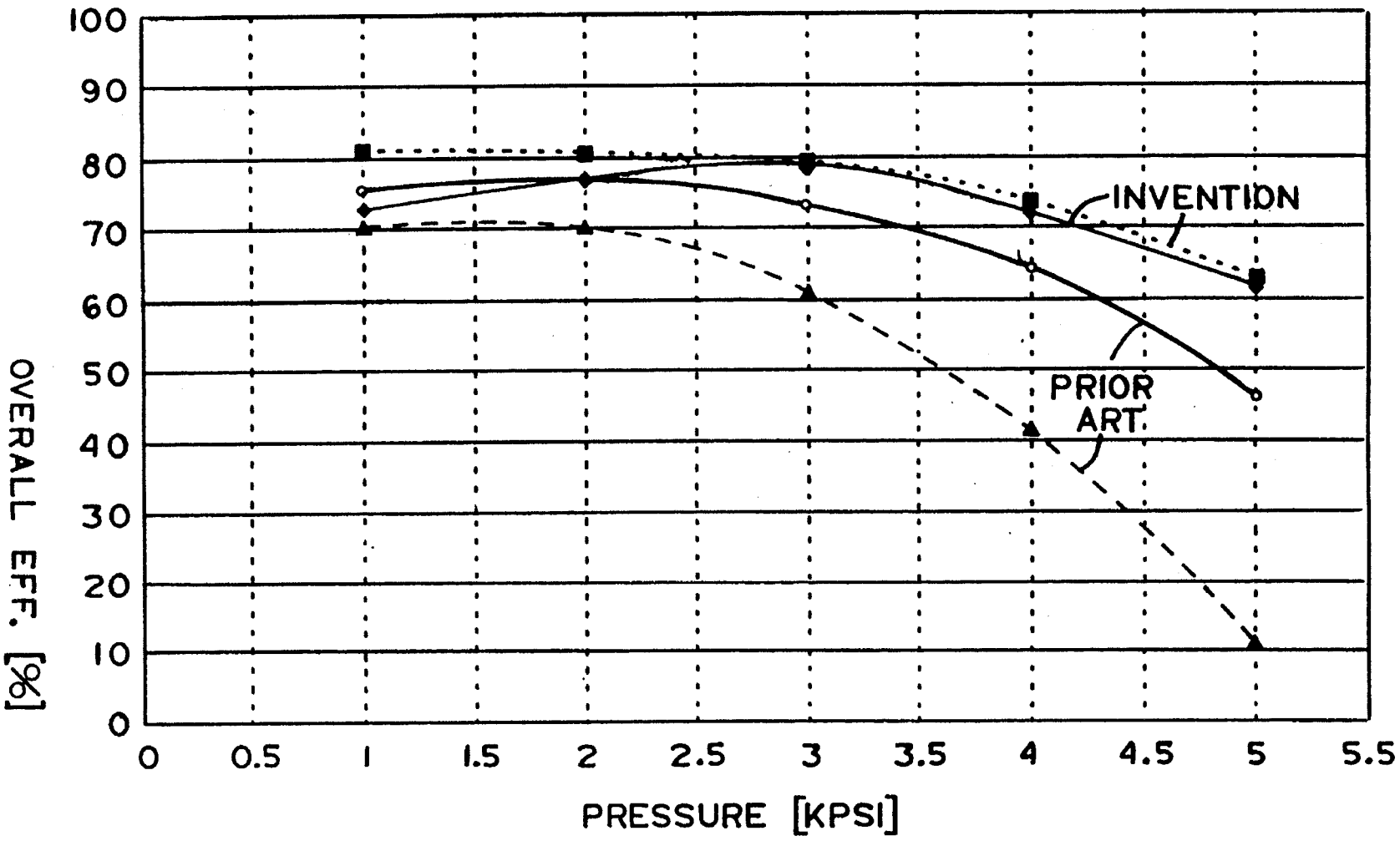
FIG. 8 is a graph of overall efficiency (as a percentage) versus system pressure (in PSI) comparing the present invention with the prior art.

Referring now primarily to FIG. 8, which is a graph of overall efficiency.(the product of mechanical efficiency and volumetric efficiency), as a function of system pressure. The two curves marked "PRIOR ART" represent a motor such as is shown in FIG. 1, but including a prior art annular groove in place of the fluid pressure region 63.

The two upper curves (marked "INVENTION") represent the performance of a motor made in accordance with the present invention, utilizing the pressure ports 65. In summary, at 5000 psi system pressure, and 10 gpm system flow, the prior art motor, operating clockwise, had an overall efficiency of about 47%, while the motor of the present invention had an overall efficiency of about 62%. More importantly, the prior art motor, operating in the counter-clockwise direction, had dropped to an overall efficiency of about 10%, while the motor of the present invention, operating in the counter-clockwise direction, still had the same overall efficiency of about 62%.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary fluid pressure device of the type comprising housing means including an endcap member defining a fluid inlet port and a fluid outlet port; a gerotor gear set associated with said housing means and including an internally-toothed ring member, defining a plurality N+1 of internal teeth, and an externally-toothed star member defining a plurality N of external teeth, said star member being eccentrically disposed within said ring member for orbital and rotational movement relative thereto, the teeth of said ring member and said star member interengaging to define a plurality N+1 of expanding and contracting fluid volume chambers during said relative orbital and rotational movements; said endcap member including stationary valve means including a first fluid pressure region in continuous fluid communication with said inlet port and a second fluid pressure region in continuous fluid communication with said outlet port, said first fluid pressure region surrounding said second fluid pressure region; said stationary valve means further defining a plurality N+1 of valve passages, each being in continuous fluid communication with one of said fluid volume chambers; said star member defining a manifold zone in continuous fluid communication with said second fluid pressure region, said star member including an end surface disposed in sliding, sealing engagement with an adjacent surface of said stationary valve means, said end surface defining a first plurality N of fluid ports and a second plurality N of fluid ports, said second plurality of fluid ports being in continuous fluid communication with said manifold zone; characterized by:

(a) each of said first plurality N of fluid ports including inward portions extending radially inwardly beyond each of said second plurality N of fluid ports;

(b) said first fluid pressure region comprising a plurality N+1 of individual stationary ports defined by said adjacent surface of said stationary valve means; and (c) each of said N+1 stationary ports being in commutating fluid communication with each of said inward portions of said first plurality N of fluid ports defined by said star member during said relative orbital and rotational movements.

2. A rotary fluid pressure device as claimed in claim 1, characterized by said first fluid pressure region further comprising a generally annular chamber, in fluid communication with said inlet port and disposed within, and surrounded by, said endcap member, each of said N+1 stationary ports being in open fluid communication with said annular chamber.

3. A rotary fluid pressure device as claimed in claim 1, characterized in that during said relative orbital and rotational movements each of said N+1 stationary ports cooperates with said inward portion of one of said first fluid ports to define a first area of overlap, and said one first fluid port cooperates with one of said plurality N+1 of valve passages to define a second area of overlap, said first and second areas of overlap being approximately equal during a major portion of said orbital and rotational movements.

* * * * *